United States Patent [19]

Griffin

[11] 4,043,573

[45] Aug. 23, 1977

[54] NOTE PAD CONSTRUCTION

[76] Inventor: Arthur F. Griffin, 1300 E. Fairhaven Ave., Apt. 6, Santa Ana, Calif. 92701

[21] Appl. No.: 486,188

[22] Filed: July 5, 1974

[51] Int. Cl.[2] ..... B42D 5/04

[52] U.S. Cl. ..... 283/2; 283/38

[58] Field of Search ..... 283/36–43, 283/24, 63; 281/15

[56] References Cited

U.S. PATENT DOCUMENTS

| | | | |
|---|---|---|---|
| 1,519,643 | 12/1924 | Van Arsdale | 283/2 |
| 2,831,278 | 4/1958 | Myers | 283/2 X |

*Primary Examiner*—Stephen C. Pellegrino
*Attorney, Agent, or Firm*—Jack C. Munro

[57] ABSTRACT

The device consists of a note pad formed of a plurality of stacked pages, each page including means to visually differentiate a given page from other adjacent pages, each said page including a plurality of separate sections, each section being adapted to accommodate writing thereon one item each in a "things to do" list, each page having a series of detachable tabs, one for each said section, the tabs of each page including the visual differentiation means of that page, the said series of tabs on each page being superposed when all pages in the note pad are lying flat. When an item that has been written in one of the said sections is acted upon, the tab corresponding to that section is detached, and the absence of said tab is prominently displayed against the contrasting visual background of the tab of an adjacent page, thus permitting the rapid visual scanning of the in-place tabs to determine the status of all items in the list.

3 Claims, 3 Drawing Figures

NOTE PAD CONSTRUCTION

BACKGROUND OF THE INVENTION

This invention relates to a note pad which provides a means for keeping a cumulative "things to do" list in which items not acted upon can be spotted at a glance even in long lists.

"Things to do" lists are normally written on pieces of paper, and when an item in the list has been acted upon, it is lined through by a writing instrument. Since items are not generally acted upon in the same order in which they are listed, unacted upon items become interspersed among items that have been completed. When such a list becomes long, possibly involving several pieces of paper, it becomes difficult to quickly spot the said interspersed, unacted upon items, which often necessitates periodically collecting and rewriting in one place said unacted upon items.

SUMMARY OF THE INVENTION

The characteristics of the note pad described herein are adequately summarized in the ABSTRACT OF THE DISCLOSURE and reference is to be had thereto.

This invention provides an inexpensive and easy to use means of keeping a cumulative "things to do" list, keeping a record of the changing binary status of items in said list (completed versus not completed) and rapidly checking the status of listed items at any time.

DESCRIPTION OF THE PREFERRED EMBODIMENT

Figure 2:
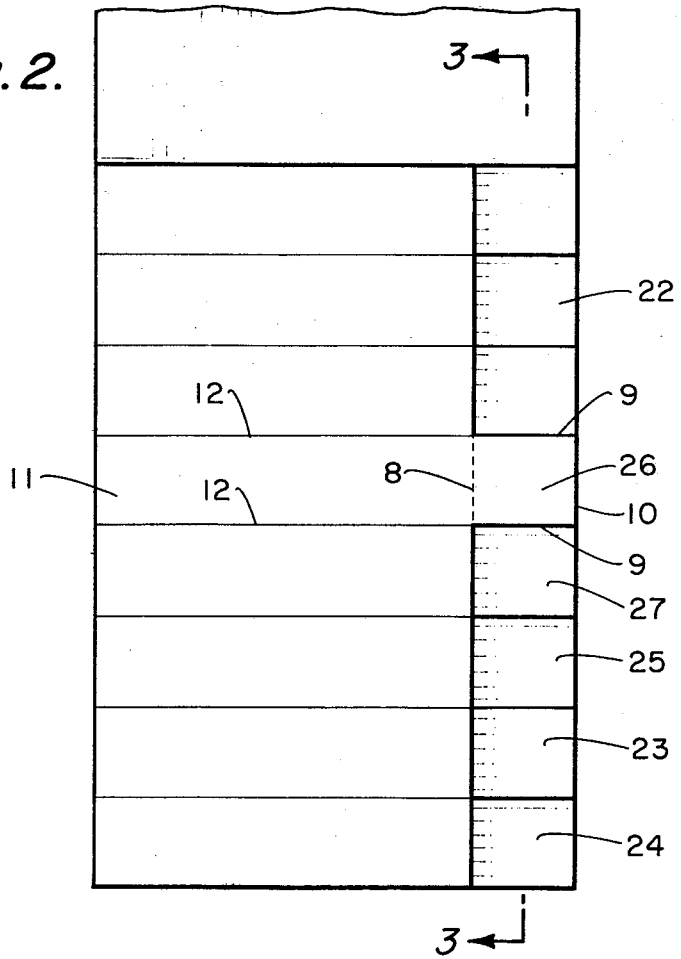
FIG. 2 is a front view of the note pad with the same arrangement of tabs as in FIG. 1.

The note pad of this invention consists of a number of paper pages bound on one edge 1. The pages are fabricated from normal writing paper. The front page 2 and the back page 3 are not perforated or cut and serve to protect the inner pages when the note pad is closed. The auxillary pages in the front 4 and the back 5 of the pad, which are not perforated or cut, carry printed instructions or other material. Each of the remaining pages of the pad, 13, 14, 15, 16, 17, 18, 19, 20 is identical with the exception of color.

There is a vertical strip along the side of each inner page consisting of a series of detachable tabs 7. The tabs are formed by a vertical perforation 8 along the entire length of the page and a series of parallel, horizontal cuts 9 from the edge of the page 10 to the perforation 8. All tabs are of identical size and shape. Associated with each tab is a section 11 formed by printed, horizontal lines 12 coincident with the horizontal cuts 9 that form the edges of the tabs.

The user writes each item of his "things to do" list in a section 11. Normally items would be entered in chronological order from the top to the bottom of the page and from the front inner page to the back inner page of the pad. Later when an item is acted upon, the tab 7 corresponding to that item is torn out along the perforation 8.

Figure 1:
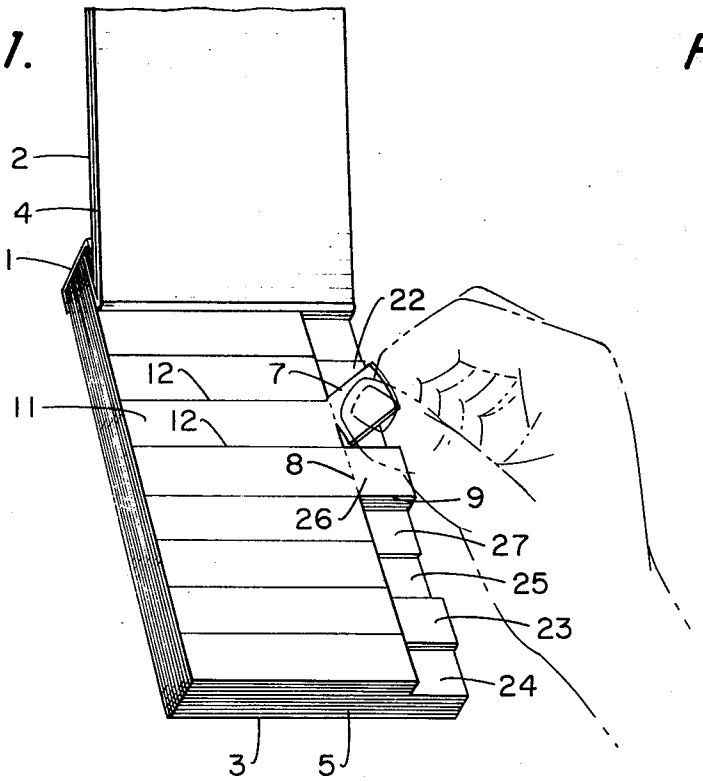
FIG. 1 is a view in perspective of the note pad with a typical arrangement of detachable tabs.
Figure 3:
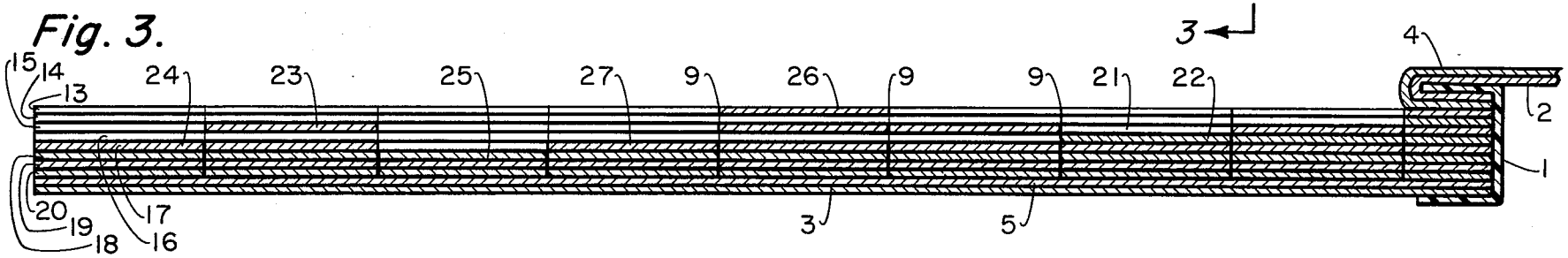
FIG. 3 is an enlarged sectional view of the note pad taken on line 3—3 of FIG. 2.

The inner pages in the pad have contrasting colors and are assembled in a repetitive color sequence as follows: geeen 13, pink 14, blue 15, yellow 16, green 17, pink 18, blue 19, yellow 20. However any color sequence could be employed. Viewing a closed pad from the front, as in FIGS. 1 and 2, a tab removed from a blue page 21 reveals the contrasting color of the coincident tab on the adjacent yellow page 22, thus visually marking the item in the section associated with the removed tab as acted upon. Conversely, a blue tab still in place 23, associated with an item not acted upon, is prominently displayed against the contrasting color background of a green tab 24 and a pink tab 25.

The entire pad can be checked quickly for items needing attention by viewing the closed pad from the front and visually scanning the visible tabs. The user can then place his thumb on an in-place tab and immediately turn to the page of interest.

When all of the tabs from one page are removed 14 and therefore no longer visible from the front of the pad, the items on that page are no longer considered when the pad is visually scanned.

If an item entered relatively early in the usable life of the pad remains unacted upon, its tab 26 can be spotted quickly in a visual scan, even though it is surrounded by acted upon items and it is chronologically well removed from the majority of unacted upon items.

It may occur that tabs of the same color but from different pages will appear adjacent to each other 26, 27. These tabs will be visually differentiated by the spatial separation between the planes of their respective pages.

I claim:

1. A note pad comprising:

a plurality of stacked pages, each said page including means to visually differentiate a given said page from other adjacent said pages, each said page including a plurality of separate vertically spaced sections, each said section being adapted to accommodate writing thereon;

each said page having a series of detachable tabs laterally positioned in respect to said sections with there being a single said detachable tab for each said section, said tabs being detached from each other, whereby each said section being adapted to receive indicia in the form of writing to denote different tasks to be performed, upon a performing of the particular task for which an indicia within a given said section denotes the particular said tab for that section is removed and the absence of that said tab is prominently displayed against the contrasting visual background of the tab of the adjacent said page, thus permitting the rapid visual scanning of the remaining tabs to determine the status of all items listed on the page.

2. The note pad as defined in claim 1 wherein:

each said tab being connected by score lines to its said section, whereby said score line facilitates removal of said tab from its connected said section.

3. The note pad as defined in claim 2 wherein:

each said tab of each said page being of the same color as that said page.

* * * * *